US006953231B2

(12) United States Patent
Markofer

(10) Patent No.: US 6,953,231 B2
(45) Date of Patent: Oct. 11, 2005

(54) COMPUTER CORNER DESK WITH WIRE MANAGEMENT CAPABILITY

(75) Inventor: Gary Markofer, Sacramento, CA (US)

(73) Assignee: California Office Furniture, Sacramento, CA (US)

( * ) Notice: Subject to any disclaimer, the term of this patent is extended or adjusted under 35 U.S.C. 154(b) by 0 days.

(21) Appl. No.: 09/883,530

(22) Filed: Jun. 18, 2001

(65) Prior Publication Data

US 2002/0189505 A1 Dec. 19, 2002

(51) Int. Cl.[7] ..... A47B 81/00

(52) U.S. Cl. ..... 312/223.3; 312/223.6; 312/195; 108/50.02

(58) Field of Search ..... 312/223.1, 223.3, 312/223.6, 196, 194, 195; 108/105, 50.01, 64, 50.02, 71, 90; 248/918

(56) References Cited

U.S. PATENT DOCUMENTS

| | | | | | |
|---|---|---|---|---|---|
| 4,345,803 | A | * | 8/1982 | Heck | 312/194 |
| 5,024,167 | A | * | 6/1991 | Hayward | 312/195 X |
| 5,130,494 | A | * | 7/1992 | Simonton et al. | 312/195 X |
| 5,416,666 | A | * | 5/1995 | Maguire, Jr. | 108/50.01 X |
| 5,536,078 | A | * | 7/1996 | Novikoff | 312/195 |
| 5,598,790 | A | * | 2/1997 | Fich | 108/158.11 |
| 5,628,257 | A | * | 5/1997 | Conner et al. | 312/195 X |
| 5,655,823 | A | * | 8/1997 | Schairbaum | 312/223.3 X |
| 5,694,862 | A | * | 12/1997 | Grubb | 108/90 |
| 5,769,514 | A | * | 6/1998 | Brown et al. | 312/195 |
| 5,823,487 | A | * | 10/1998 | Kirchhoff et al. | 248/918 |
| 5,901,513 | A | * | 5/1999 | Mollenkopf et al. | 108/50.02 X |
| 5,927,662 | A | * | 7/1999 | West et al. | 248/918 |
| 6,180,884 | B1 | * | 1/2001 | Tokunaga et al. | 312/223.6 X |
| 6,196,648 | B1 | * | 3/2001 | Henriott | 312/196 |

FOREIGN PATENT DOCUMENTS

| | | | | |
|---|---|---|---|---|
| EP | 0312369 | * | 4/1989 | 312/195 |
| EP | 0572025 | * | 12/1993 | 312/195 |

* cited by examiner

*Primary Examiner*—Lanna Mai
*Assistant Examiner*—Hanh V. Tran
(74) *Attorney, Agent, or Firm*—Mark C. Jacobs

(57) ABSTRACT

An advanced data electrified fully adjustable computer corner desk having a keyboard platform recessed into work surface that comprises a corner section and adjacent furniture components. The work surface of the corner section is pentagonal and has a front edge slightly greater than that of the keyboard platform. The two side edges of the corner section are at 45° angles to the front edge, and are of a lesser extension than the two rear edges that form a 90° angled corner. Disposed on the underside of the work surface is a control switch for the activation of a surge protection unit and wire management means. The wire management means includes a horizontally disposed aperture at the rear corner spaced slightly from the two rear edges, and at least one vertically disposed wire grommet situated in a modesty panel.

8 Claims, 5 Drawing Sheets

(Prioir Art)

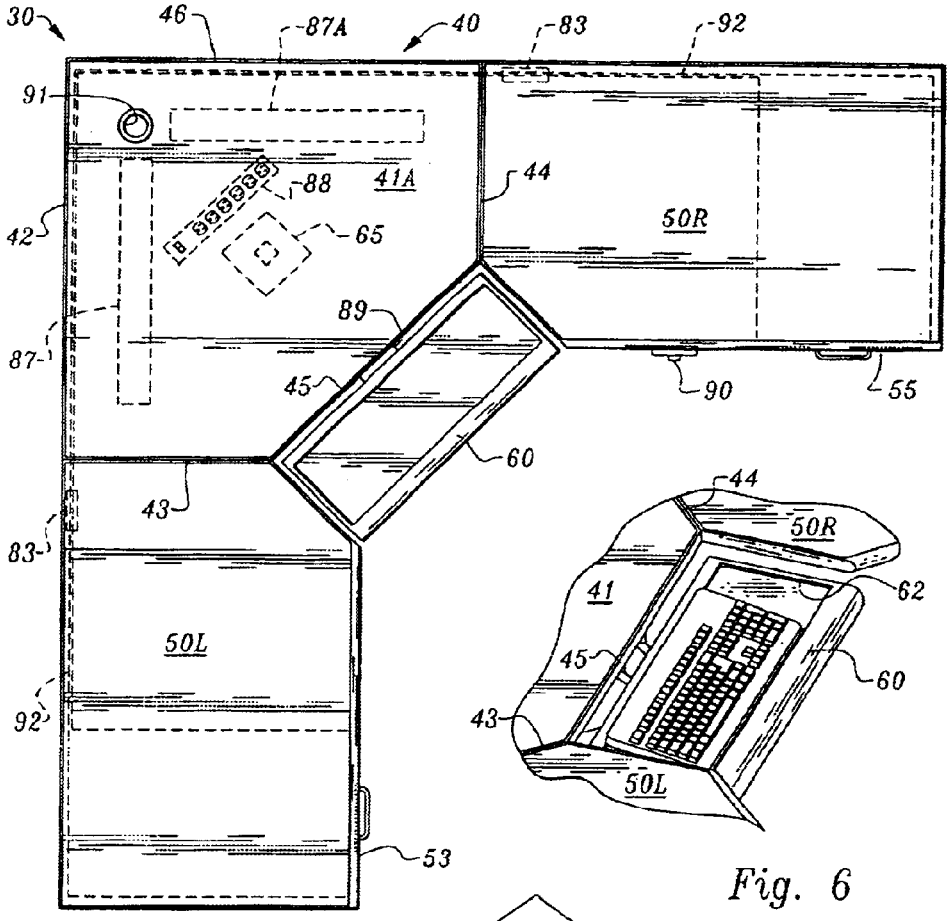
Fig. 4
Fig. 6
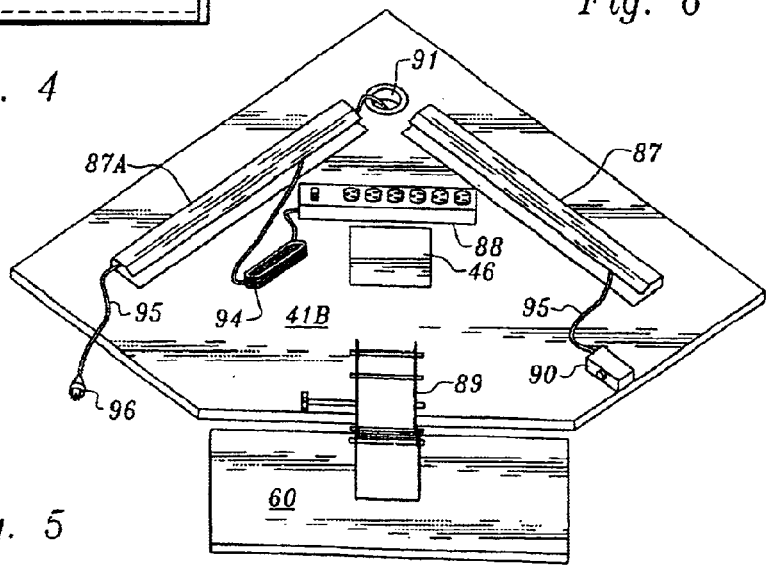
Fig. 5

COMPUTER CORNER DESK WITH WIRE MANAGEMENT CAPABILITY

FIELD OF THE INVENTION

This invention pertains to a computer corner desk and the electrical and wire management components used therewith.

BACKGROUND OF THE INVENTION

In prior art corner computer desks, such as shown in FIG. 1, the side edges of the pentagonal corner extend the full depth of the sided member. The keyboard is seen when extended into its inuse position, extends out beyond the front face of each desk side member. In such a desk the position for the mouse pad or trackball is distant from and at a higher elevation than the keyboard. This can lead to carpal tunnel and other disorders of the hand and backaches as well, due to necessity to use boarding house reach to use the mouse from a position behind the keyboard. Details of these problems will be recited to fuller extent infra.

In contrast applicant's invention of a uniquely designed corner desk permits the user to sit inwardly more toward the monitor. Such a position also presents less stress to the body since the mouse pad or trackball is adjacent to the keyboard in the more preferred embodiment.

Applicant is aware that larger keyboard shelves exist that include space for the mouse or for a trackball, but even with that capability, the user will not have overcome the problems associated with the prior art corner desk construction. The term CONSTRUCTION as used here refers to physical configuration and not to whether the desk is solid wood versus having a wood veneer or high pressure laminate covering over a core. The prior art unit's problems include sitting in a position distal to the monitor and not proximal as with this invention. Plus in a crowded area, where corner desks are often employed, computer users could be blocking the aisle because the keyboard is positioned beyond the edge of the desk.

In addition, the corner computer desk of this invention is easier and cheaper to make with appropriate front beveled edges than are prior art corner desks that have inside corners per FIG. 1 as will be explained supra.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

BRIEF DESCRIPTION OF THE FIGURES

FIG. 4 is a top plan view of the computer corner desk of this invention, with two side members.

FIG. 5 is a bottom plan view of the inventive desk with the electrical and wire management components installed.

FIG. 6 is a top front perspective view of a portion of the desk of this invention.

SUMMARY OF THE INVENTION

An advanced computer desk that features a keyboard platform positioned proximal to the user's monitor, by being disposed inset within the corner of the desk's work surface, and which platform and the positioning thereof permits both a mouse or trackball to be disposed close to the user and for the user to enjoy extra chair movement space behind the computer in close quarters facilities. The cable management aspect of this invention provides neatness and frees the desk of excess clutter by directing wiring and cables through a rear corner grommet, through at least one wire management trough, and then out via a vertically positioned grommet disposed in an inset modesty panel for outlet connection.

It is a first object to provide an ergonomic corner computer desk that provides easy and comfortable aces to both keyboard and mouse/trackball.

It is a second object to provide means of managing the electrical outlets of the advanced computer desk.

It is a third object to provide wire management means as part of the advanced corner computer desk.

It is a fourth object to retain the largest space possible behind a worker who toils within the confines of a cubicle.

It is a fifth object to enlarge the space within which a chair can move away from a keyboard to give a feeling of spaciousness to a worker in a confined area.

It is a sixth object to create a wire neat work surface in a corner desk.

These and other objects will in part appear obvious and will in part be discussed in the specification, drawings and claims of this invention.

DESCRIPTION OF THE PREFERRED EMBODIMENT

Figure 1:
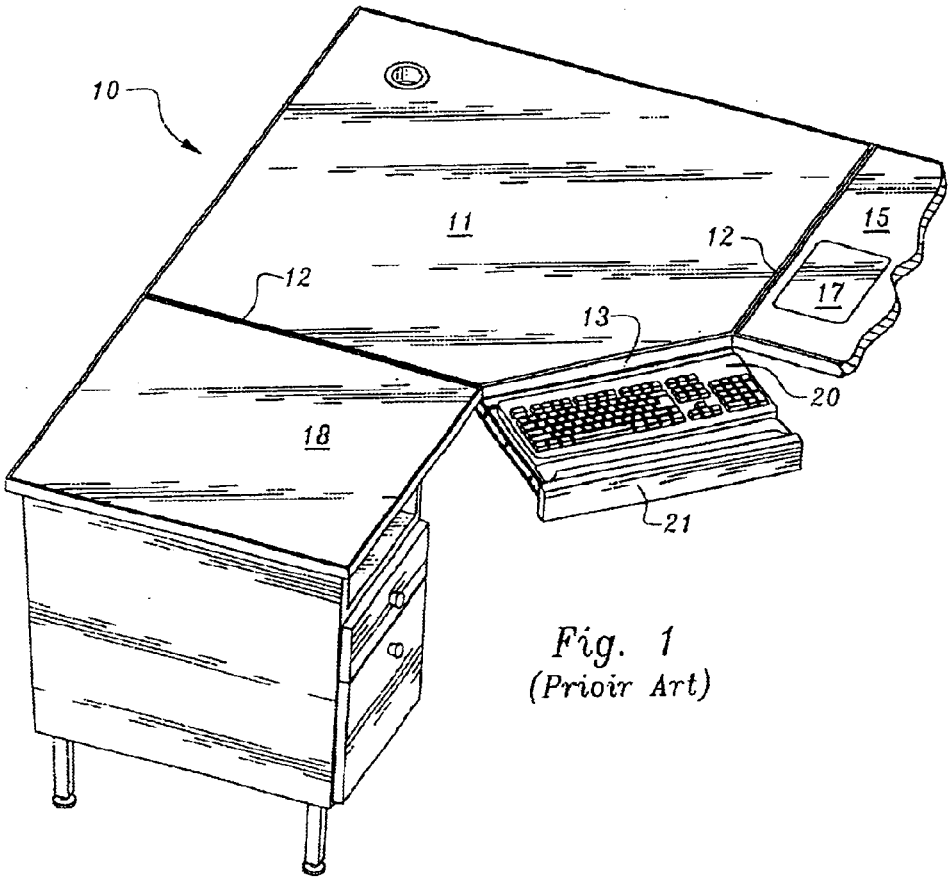
FIG. 1 is a front perspective view of a prior art computer corner desk.

To understand the advanced computer desk of this invention, a brief discussion of the prior art corner computer desk of FIG. 1 is in order.

Here, the prior art corner desk 10 features a pentagonal corner shelf 11, the two sides 12 of which adjacent the front edge 13 being full depth, i.e., the same depth as the furniture components adjacent thereto. That is, the depth of the two side edges 12 of the corner desk 10 are of the same depth as the two furniture components 15 on adjacent sides of the corner desk. These side components 15 can be of any configuration such as one of a file cabinet, printer stand, shelf, book case or other furniture member as may be desired. Here in FIG. 1, a shelf 15, is depicted on the right of the right edge 12 of the prior art desk 10 and a storage cabinet 18 is shown on the left of the work surface 11 of the desk 10.

Keyboard 20, rests on keyboard shelf 21, moves in and out continuously from underneath work surface 11 and as can be seen sticks out into the room.

The reader's attention is directed to the relative positioning of the keyboard shelf 21, wherein the entire keyboard shelf 21 extends beyond the front edge of the adjacent furniture components 15 and 18. The abbreviation A.F.C. will be used to signify adjacent furniture component. A.F.C.'s can be shelving, low lateral files, a "return", etc., which are disposed adjacent the corner section.

Figure 2:
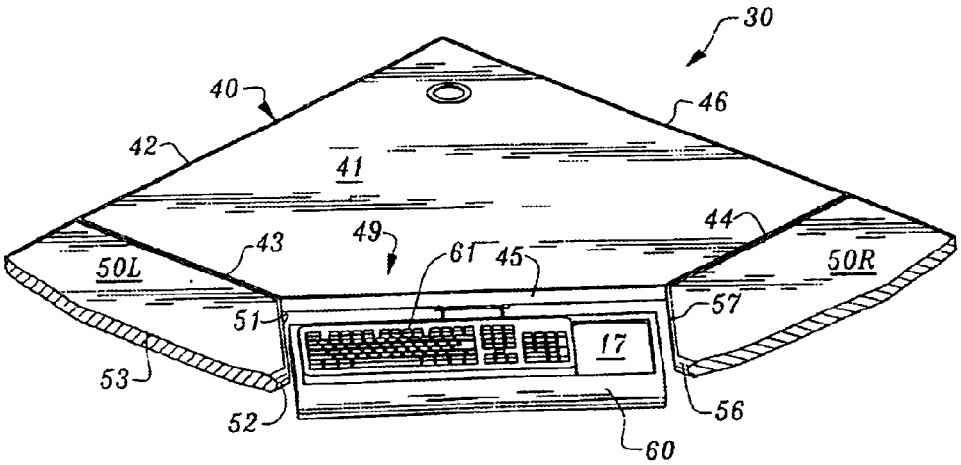
FIG. 2 is a front perspective view of a computer desk according to this invention.

In contrast FIG. 2, which features the advanced computer desk of this invention 30, having a corner section 40, the work surface of which is the pentagonal shelf 41. It, 41 has side edges 43 and 44 which do not extend the full depth of the adjacent side furniture components. The front edge 45 of the corner section 40 is recessed, rearwardly away from the front edge 52 of the adjacent furniture component 50L, having shelf member 53 situated to the left and rearwardly also from the front edge 56 or the A.F.C. 50R shelf member 53 on the right of said advanced computer desk 30's corner section.

It is seen therefore that a generally U-shaped space 49, denoted in FIG. is defined by oblique side edge 51 of the left shelf 53, front edge 45 of corner section 40 and oblique side edge 57 of the right side shelf 55. The work surface 41 is pentagonal in shape and has a front edge slightly wider than the keyboard platform with mouse space 61. The two side edges 41 and 43 are disposed at a 45° angle, and are of shorter extension than the two rear edges that form a 90° corner. Typical dimensions for the two smaller side dimensions 41 and 43 range from fourteen to sixteen inches, whereas the two rear edges range from thirty to thirty-six inches.

The preferred keyboard platform 60 used in this invention, has adequate room laterally for the full size Windows® keyboard 61, as well as a mouse pad 17.

In extension this is about twenty-seven. The standard keyboard platform of twenty-two inch widths may also be employed in the latter case as in the prior art corner section, the mouse pad needs to be placed at a different elevation on the adjacent side furniture component due to insufficient lateral extension of the keyboard platform, see FIG. 1 the use of the mouse at a different elevation and at some distance makes for muscle strain. The same space that accommodates a mouse pad will also permit use of a trackball if such is preferred by the typist.

The extension of the two rear edges 42 and 46 of work surface 41 of this corner section 40 are of the exact same extension as the prior art corner section. Thus it can be seen that the footprint of this invention, the advanced computer desk corner section, is the same as for the prior art corner section.

An added benefit gained by having the recessed keyboard platform 60, is that the deep rear corner formed at the intersection of edges 42 and 41, is easier to reach than the rear corner shown in FIG. 1. But more importantly, by having the seam or groove between adjacent sections relocated to be at the back of the keyboard recess, those persons who want to use the mouse at counter height, will not have the irritation of the groove between sections to contend with, as is the case for persons who put their mouse pad 18 over the groove at edge 12 of the prior art corner unit, per FIG. 1.

Figure 3:
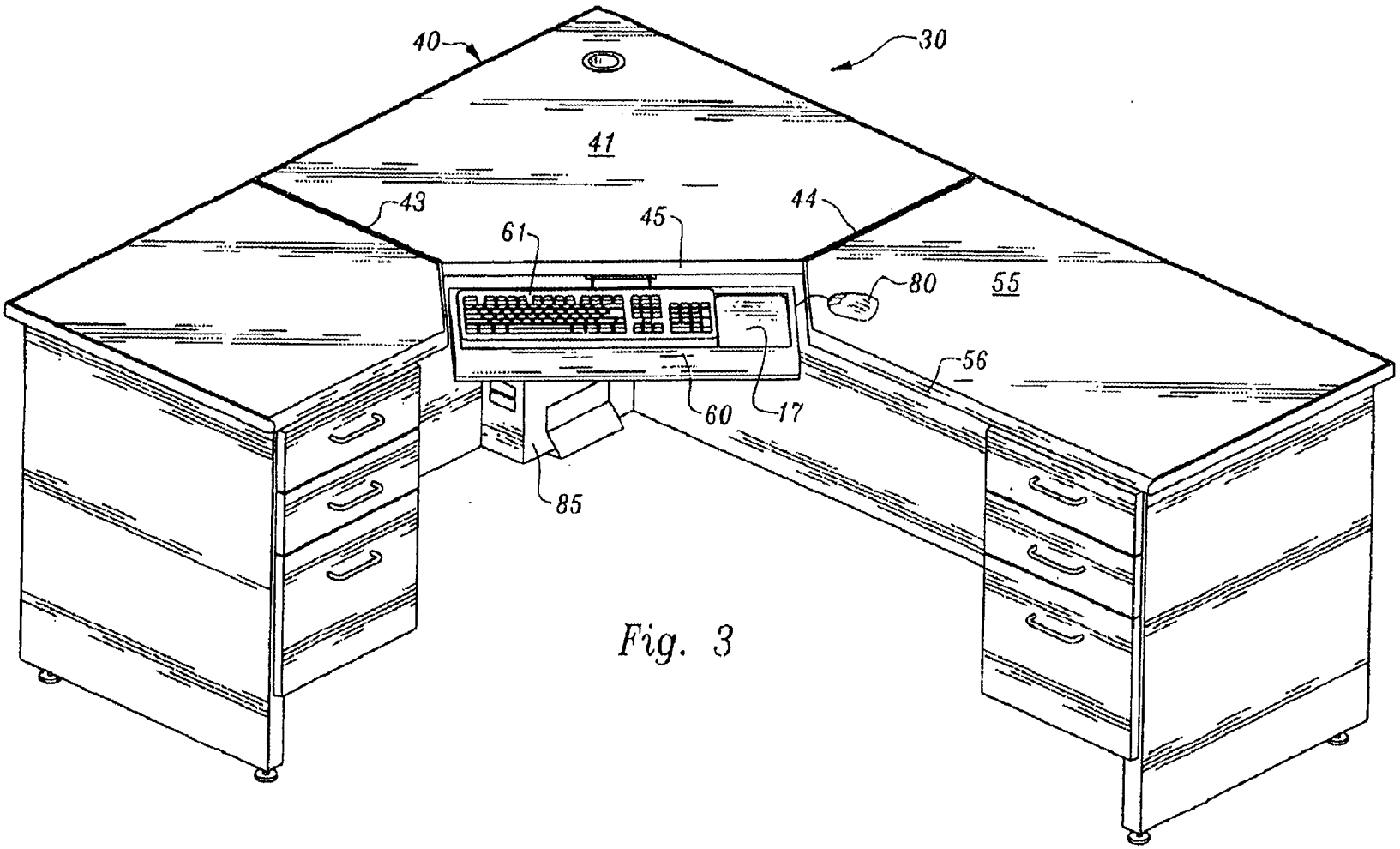
FIG. 3 is a top perspective view of the computer corner desk of this invention.

In the top perspective view of FIG. 3, the mouse 80, is seen to have been moved off the pad 17 to the shelf 55, from its normal position on mouse pad 17 which is disposed on the keyboard platform 60. But this was done to reemphasises the fact that in this corner section 40, the mouse may be utilized readily at hand without fear of hitting the crevice.

One big economic benefit to the consumer arises from the fact that this corner section can be manufactured less expensively than the prior corner section, in that a single edge bander pass can complete the lamination or veneering, as the case may be, of the two side edges 41,43 and the front edge 45, all of which have a hard corner interface from the horizontal work surface to the vertical side. Whereas in the prior art, it was necessary to have a curved front edge 13 to avoid possible injury to the corner section user, the front edge of the work surface of this invention is at a 90° angle to the elevation of the work surface, 41.

As can be seen in FIG. 3, when the keyboard platform 60 is extended to its forward position for use, it appears to extend about four inches, equal to or less than, beyond the edges of the two adjacent furniture components, but this is due to parallax. A closer view with a better perspective, namely FIG. 6, shows that the keyboard platform 60 protrudes forwardly minimally if at all. This saving of as much as ten to twelve inches over the inuse position of a prior art keyboard platform 21, helps the worker to have more room to move his or her chair behind the corner section since the user sits in a more forwardly position than with the prior art computer corner section. By sitting closer to the monitor, eye fatigue is avoided while the corner section 40 can be used by itself on a pedestal. What makes this corner section 40 work best is to use the specially designed adjacent furniture components 50L and 50R in conjunction therewith to create the advanced L-shaped computer corner desk 30 of this invention.

Figure 10:
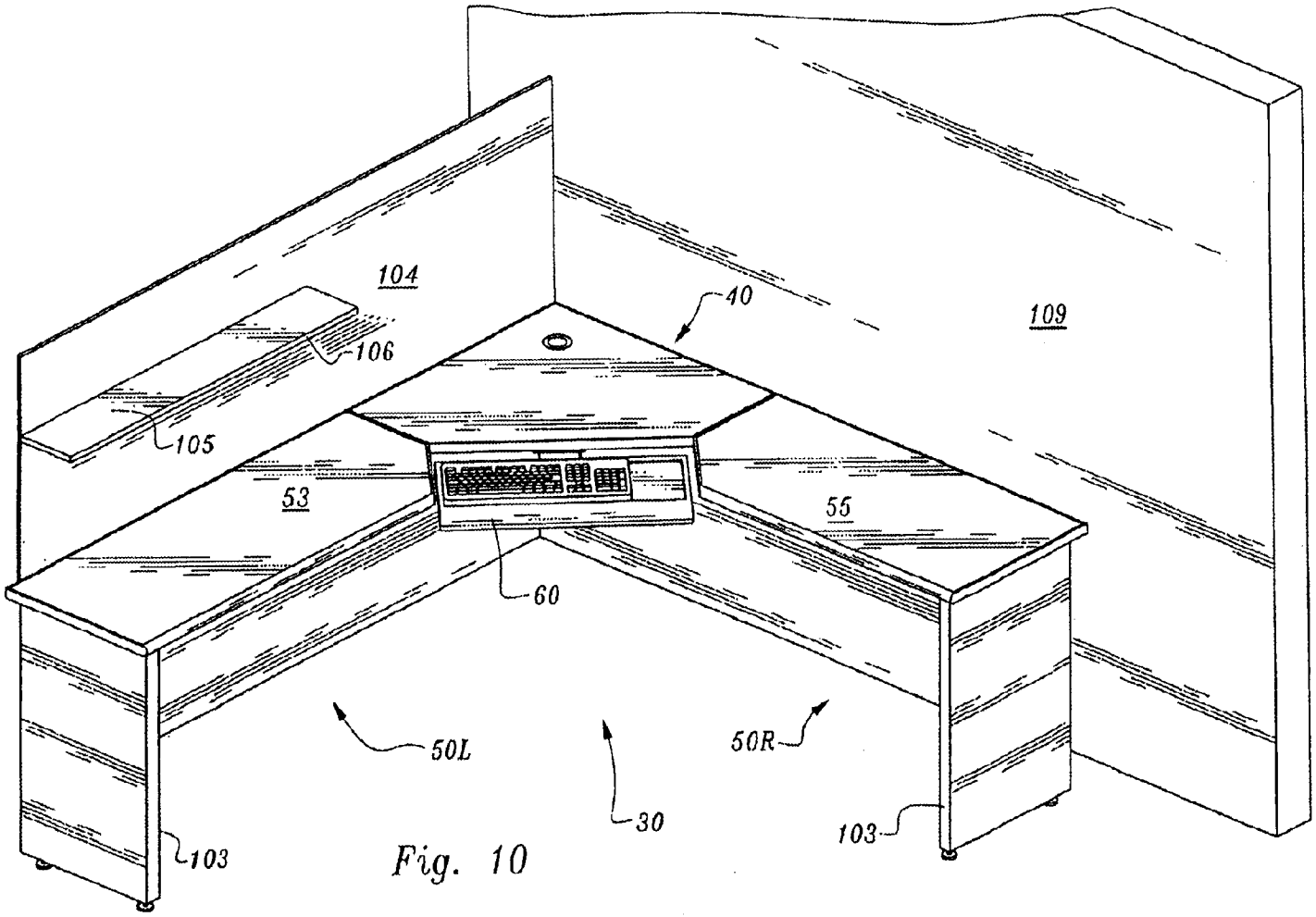
FIG. 10 is a diagrammatic perspective view of a preferred installation of the corner desk of this invention in a corner desk system.

In FIG. 2 the adjacent furniture components 50 comprise shelves 53 and 55, the balance of the component being shown and described in the discussion of FIG. 10. Each of these shelves 53,55 has a front edge parallel to a rear edge and a side edge normal to the rear edge. The shelves of these adjacent furniture components also have an oblique edge, here 51 in one and 57 in the other component, that intersect the front edge of the computer corner section to which they are abutted at a 90° angle. Preferably the side edges of these adjacent furniture components are of the same depth as the side edges of the corner section. When these adjacent furniture components are attached to said corner section for added stability, the pedestal shown in FIG. 4 can be eliminated, as the corner section 40 will have adequate side-wise support.

While the adjacent furniture components 50L and R on both sides of the corner section 40 are shown to comprise shelf members 53 and 55, cabinets having an oblique side as opposed to a shelfs oblique edge may be used. Multiple shelves and bookcases may also be incorporated into A.F.C.s and used as adjacent furniture components. They too should preferably be attached to the corner section 40 for added stability of the corner section, and configured with the oblique side, per FIG. 10.

The keyboard platform 60 preferably has a depth 62 from front to back substantially equal to the oblique edge of the adjacent furniture components. For ease of understanding, the reader is best directed to FIG. 10 and the discussion below.

FIG. 4 illustrates the construction of the advanced computer desk with A.F.C.'s adjacent the corner section 40 of this invention. Here corner section 40's work surface underside 41 is seen having the aforementioned rear edges 42 and 46 which interface at a corner 47, and the two shorter extension side edges 44 and 45 which respectively lie between the front edge 45 and the respective rear edge. An optional mount plate 65 may be conventionally attached to underside 41, to receive a conventional pedestal 66 of any standard configuration. The keyboard platform 60 is preferably retained by a commercially available swing away hinge for mounting to the underside of the work surface 41B. Such a hinge 89 is shown in FIG. 5.

One source of such a hinge bracket 89 is Webber and Knapp. Hinge bracket 89 permits the keyboard platform 60 be moved to a downwardly and rearwardly position beneath surface 41 when not being utilized. Slide out brackets, not seen, which are mounted to the underside of the work surface, 41B may also be employed for mounting the keyboard but are less preferred.

In this top plan view A.F.C. 50L and 50R are seen adjacent the two short sides of the corner section 40 of the advanced corner desk of this invention.

The recessed modesty panels 92 for the A.F.C.s and 93 on each of the two rear sides of the corner section are seen to be recessed in from the outer edge of the A.F.C. and corner section respectively as denoted by the dashed lines set in from the edge. By recessing the placement of the modesty panels less than about two inches, electrical plugs can be engaged in a wall-mounted outlet, without the need to move the entire desk away from the wall a distance corresponding to the extension of the rigid plug, usually less than two inches.

For example, wiring with a plug could exit the vertical wire grommet 83 discussed supra to engage a wall socket. See FIG. 7.

The rear aperture 91 through which the monitor's video connector cable and electrical wire can be fed is seen here as well as in FIG. 5.

The two wire management troughs 87 and 87A discussed in detail with reference to FIG. 5 are seen here as well.

In FIG. 4 the master control switch 90 for the electrical components, printer, mother computer and the like are seen mounted to the underside of the shelf of 50R, whereas in FIG. 5, this switch 90 is shown in an alternative equally as accessible location on the underside of the corner section 40. Such choice is at the discretion of the buyer for personal comfort.

The surge protector 88 is shown in dashed lines mounted on the underside of the corner section 40. While any surge protector of sufficient joules can be utilized, I prefer to use one that incorporates protection for both telephone via an RJ 11 jack, and LAN cabling, via an RJ 45 jack, both of which are surge protected. Such surge protectors are available in the marketplace.

If desired another vertical grommet 83 may be disposed in an A.F.C. 50L modesty panel 92.

While an ordinary wood shelf or high pressure laminate cover or core be used as the keyboard platform, I prefer to use a hard rubber unit which is easily installed, dirt resistant and made for ergonomic use. Such units have a gel palm rest, are cleaned with soap and a little water. Keyboard platforms of this nature are made by Grand Stands, Inc. among others.

The discussion moves now to FIG. 5, wherein the wire management electrical outlet controls aspect of this invention are seen in close-up. At least one and preferably a pair of channels 87 and 87A are attached by screws to the underside 41B of the corner section 40. The location of the aforementioned components can be readily discerned on the completed corner section, as template notes where the pedestal mounting plate 65 is to be attached.

The wire and electrical management system is controlled by the on-off master switch 90 mounted to the underside of the work surface 41. This may be a rocker switch or a pushbutton, since both exist in the marketplace. The wiring from switch 90, designated 95 passes through the length of channel 87, makes a bend and comes out channel 87A and terminates in a three-prong electrical plug 96, for added safety.

Figure 8:
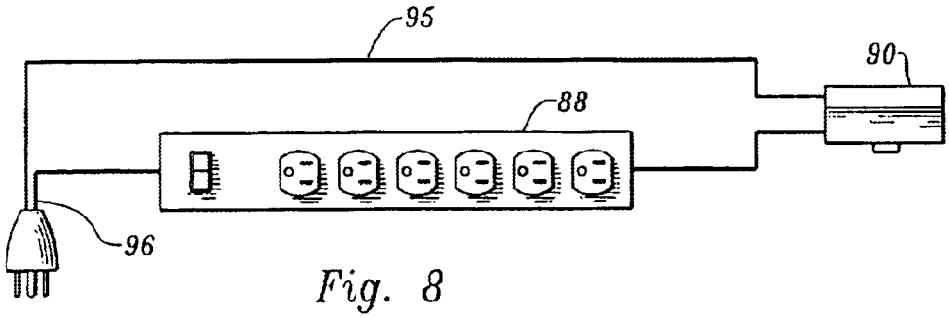
FIG. 8 is a wiring diagram of the electrical control and wire management system.

At some location along line 85 the wiring for the surge protector 88 is interposed on one side of the wiring, in a conventional manner. Surge protector units which have, as this one does, a plurality of electrical outlets thereon are well known and are available from such vendors as Belkin, Curtis, Kensington and others. Reference is made to FIG. 8, the wiring diagram. Surge protector unit 88 shown include provision to protect the modem and calling as discussed infra. Thus as is well understood, the telephone wire with modular jacks thereon, shown as bundle 94, also plugs into the surge protector 88. Until such time, as switch 90 is activated to the on position, the components plugged into the surge protector's outlets are inoperative.

From FIG. 4 it is shown that cables from the corner section top computer, if such is utilized, an adjacent printer and/or scanner, and from the monitor pass preferably through the corner section 40's top 41's large aperture 91 in the rear corner. The aperture should be of a diameter to permit a plurality of component line cords to pass there through. The use of this aperture 91 enhances the aesthetics, especially when a modesty panel is employed. Wires need not drape down the panel and then be tucked around the panel. Nor need the panel be drilled or raised to permit the wiring from the computer components to be plugged into the surge protector.

The channels 87 and 87A, seen in FIGS. 4 and 5, are referred to in the industry as J-shape wire managers. They may be attached to the underside of the corner section 41B by double sided tape or by stapling them to the surface. These wire managers are the subject matter of U.S. Design Pat. No. 295,521 and are readily available in the marketplace in a variety of colors as may be desired from Doug Mocket and Company of Torrance, Calif.

FIG. 6 shows the seam of the A.F.C. where it abuts the corner section in an out of the way location spaced closer to the rear corner of the corner section 40. A modesty panel 92 is shown conventionally attached recessed inwardly on the A.F.C. 50R from the side edge, here 44, of the corner section 40, for the reasons recited in the discussion of FIGS. 4 and 7.

Figure 7:
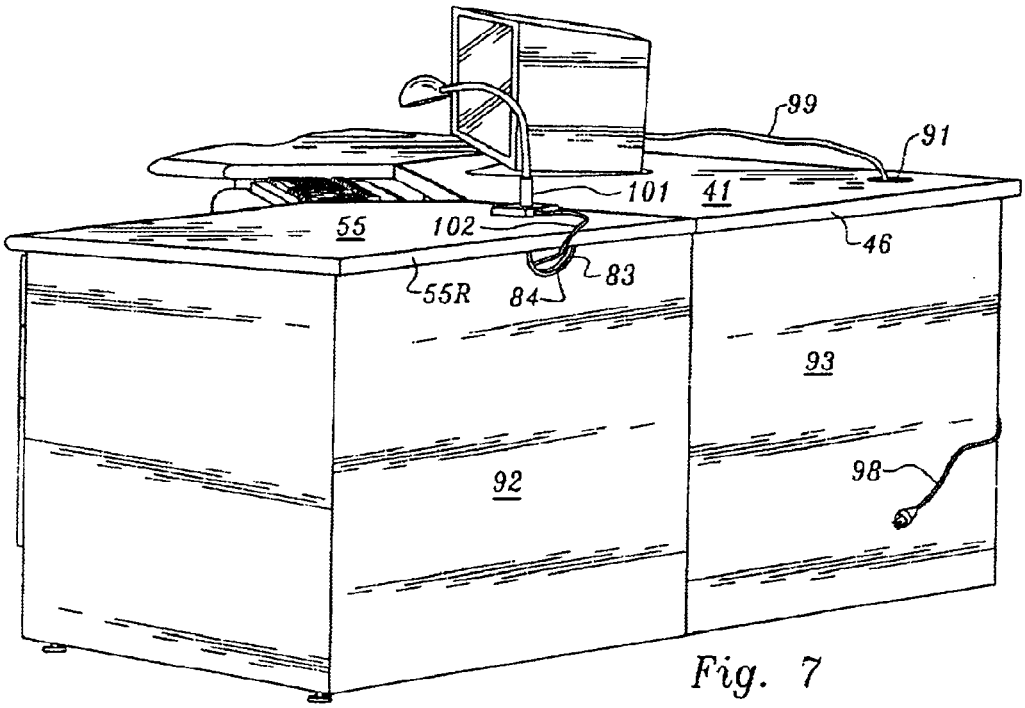
FIG. 7 is an elevational view of the rear of an adjacent furniture component and of one rear edge of the inventive desk with a vertically disposed grommet therein.

FIG. 7 is a rear perspective view that illustrates two additional features of this invention. The first is the use of the recessed modesty panels 92 and 93 respectively and which were discussed earlier. Panel 93 is seen to be attached in conventional manner to the corner section, while panel 92 is attached as noted to the adjacent furniture component. By recessing the modesty panels between two and four inches from the rear surface 46 of corner section unit 46, and 55R of the adjacent furniture component, cables and plugs such as 98 can be plugged into outlets behind edges 46 and 55R—not seen in this figure, and thereby permitting the A.F.C. to abut the wall without interfering with the electrical plugs present. Note wire and plug 98 peeking from around the corner, which are not visible from above.

The second additional feature present in this figure is vertical wire grommet which has at least one and often three slots for the receipt of individual wires 102 to pass for example from corner section lamp 101 through the grommet 83 to the surge protection unit 88 discussed elsewhere herein. Grommets of this nature are manufactured by Hardware Concepts Inc. of Opa Locka, Fla. If the user desires to plug the desk lamp into the surge protection unit, the rear surfaces 46 and 55R need only be spaced less than ½ inch from any wall, as opposed to the usual two inches or so needed for a wire and its plug, or more room if a multi-outlet adapter is employed in the typical wall two gang electrical box.

More often however, the electrical wire and plug from the surge protection unit passes the other direction from beneath the desk pedestal 41 through the grommet to the wall outlet (electrical interconnect).

It is deemed preferable to employ both the concept of the recessed modesty panel and at least one wire grommet for maximum flexibility in location and user convenience, but either feature can be utilized alone.

This view also shows the location of aperture 91 at the rear corner and the disposition of video cable and electrical line 99 passing therethrough to the surge protector unit 88 and the computer respectively.

Previously reference has been made to FIG. 8, the wiring diagram. Here it is seen that switch 90 is placed in line on wiring 95 such that surge protection multi-outlet box 88, which is also disposed on one side of line 95, will not function until switch 90 is in the on-position. Any conventional toggle or pushbutton switch may be employed as the master control.

Figure 9:
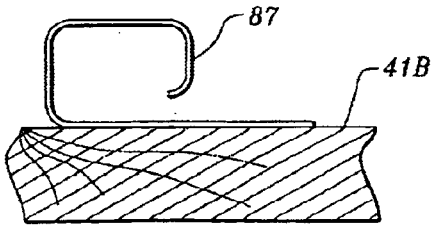
FIG. 9 is a diagrammatic view illustrating the mounting of one component of the desk of this invention; namely a wire management trough.

FIG. 9 is an inverted elevational view to illustrate both the configuration and the mounting of the J-shaped channels 87 and 87A for wire management on a substrate. Here they are mounted to the underside of writing surface 41, of corner section 40.

In FIG. 10, the entire advanced computer corner desk 30 of this invention is shown perspective seen up against a wall 109 as contrasted to a top plan view of FIG. 4. In the middle tucked into the corner is the corner section 40 comprised of the corner writing panel 41 and attached keyboard platform 60. Note the absence of the pedestal for support. Support here comes from having the corner section 40 attached to the A.F.C. 50L which is referred to in the industry as a "return" and which comprises the shelf 53, the vertical pedestal 103 disposed between the shelf 53 and the floor, and the back panel 104 to provide needed rigidity. An optional shelf 106 is shown attached to the back panel. Such is considered conventional for book storage, pictures and other personal effects.

On the other side of the corner surface 41 is the A.F.C. 50R. It too comprises a "return" having a pedestal 103, and an optional modesty panel recessed inwardly for the reasons aforementioned, 92—shown in dashed line. The corner section likewise has a modesty panel 93, for modesty and for support. Thus it is seen that reduced to its basics, the desk of this invention comprises a left return having at least pedestal and shelf, and a right return with a pedestal and a shelf. The back panel and modesty panels, though optional lend rigidity and aesthetics and are highly recommended. The term at least is used to describe this desk, as one may choose to add a roll-away set of shelves such as those designated 97 in FIG. 6, or one can have shelving or drawers physically attached to the shelf 53 or 55 as may be desired, but disposed such as not to interfere with the required oblique side of each of 50L and 50R.

While shown in FIG. 10 with but one back panel, modesty panels 92 and can be replaced by a rear panel such as 104 as well when the desk is to be used in the middle of a room, as one quarter of four cubicles abutted together.

One furniture feature that I prefer as a more desirable keyboard platform rather than a wooden one is the hard rubber unit with gel wrist rest made by Grand Stands, Inc. The unit is readily cleaned with a moist rag when combined with the Webber & Knapp or a Sunray mount. The keyboard can be placed at a correct height ergonomically correct for the individual user. These keyboard platforms also provide lateral space for a mouse or trackball.

By combining the unique recessed keyboard platform construction, in combination with the wire management and outlet controls and the use of aforementioned grommets, a most advanced computer corner section has been achieved. This corner section allows for the user behind the keyboard to be the ideal fourteen inches from the monitor, and permits the user to reach the far corner of the corner section easier. This means that more of the available space is usable by the typist so they have adequate room to roll back an ergonomic chair from its inuse position and still not bump into a credenza or other furniture usually placed forty-eight inches to their rear. In addition, all wiring is out of the way such that the janitorial staff need not worry about causing problems with the computer equipment due to inadvertent unplugging of a key component.

The typist may also enjoy a one button operation safety factor for his or her computer corner section. All of the computer parts are surge protected and no bending is needed to activate the computer system.

Usually the corner section will not be used alone, but will be integrated into and form one aspect of the advanced computer corner desk of this invention as described herein.

The advanced computer corner section can have any material utilized for its writing/work surface. Mention may be made of wood, high pressure laminate, such as Wilsonart® or Formica®, and wood veneers. The same is true for the materials to be used for the modesty panel accessory that prevents a person's legs from being seen while seated at the corner section.

In conclusion it is seen that I have designed a data-electrified computer corner workstation with an inset fully adjustable keyboard platform. The insetting of the keyboard platform provides a space-saving advantage in that it permits more square footage to be allocated for the computer user's chair within the defined workstation Preferably this keyboard platform is a rubberized one and includes a built-in wrist rest, and is laterally wide enough for placement of a mouse or trackball on the right or left side of the keyboard placed thereon. As to the data electrification aspect, there is provided a surge protected multi-outlet connector box, preferably with phone and data jack surge protection, and with preferably a separate user mountable on-off switch. Wire management includes a grommet for the exiting of above work surface wires and cables to below the work surface, at least one wire management trough and a vertical disposed grommet positioned in a spaced in from the edge modesty panel to permit the particular wiring and cables to exit from beneath the work surface to wall or floor mounted interconnects.

Since certain changes may be made in the above described apparatus without departing from the scope of the invention herein involved, it is intended that matter contained in the above description and shown in the accompanying drawings shall be interpreted as illustrative and not in a limiting sense.

I claim:

1. An advanced computer corner desk section comprising:

a corner section comprising a pentagonal work surface having a top side and an underside with a front edge, two side edges in which each one is on the opposite ends of the front edge and disposed at a 45-degree angle to said front edge, and two rear edges which meet at a 90-degree angle, the extension of the side edges being less than the extension of the rear edges, a keyboard platform mounted beneath said front edge and which moves outwardly from said front edge for utilization and sized in one dimension up to about 27 inches to receive both a keyboard and an adjacent mouse, the underside of said work surface having a control switch electrically connected to a surge protector unit having a plurality of electrical outlets therein for said switch to electrically activate or deactivate the surge protector, said surge protector having a line cord and plug thereon, and said work surface having an aperture therethrough near the 90-degree angle at the rear corner thereof, said aperture through said work surface sized in diameter to permit a plurality of computer component line cords to pass therethrough, including wire management means disposed on the underside of the work surface of the corner section, adapted to receive wiring from both of a control switch and surge protection, and further wherein said corner desk section has recessed modesty panels which are disposed beneath the rear edges of the work surface, inset from the rear edges of the work surface to permit wiring to be hiddenly disposed behind the inset modesty panels;

wherein the wire management means is two J-shaped channels each mounted at a 90-degree angle to each other along the rear edges.

2. In the corner desk section of claim 1, wherein the work surface is selected from the group consisting of wood and high pressure laminate.

3. An advanced computer corner desk comprising a corner section having a pentagonal work surface having a top side and an underside, said work surface having a front edge and two side edges, each on the opposite ends of the front edge and each disposed at a 45-degree angle to said front edge and having two rear edges which meet at a 90-degree angle, the extension of the side edges being less than the extension of the rear edges, a keyboard platform mounted beneath said front edge and which infinitely adjusts up and down and tilts to a negative or positive position and which keyboard platform is sized in one dimension up to about 27 inches to receive both a keyboard and an adjacent mouse, wherein the underside of said corner section's work surface has a control switch electrically connected to a surge protector unit having a plurality of electrical outlets therein, said corner section's work surface having an aperture there through with a grommet disposed therein, said aperture sized to permit a plurality of computer component cords to pass there through, wherein the side edges of said corner desk section range in extension from a front edge from about 14 to 16 inches to said rear edges, and further wherein said corner desk section has recessed modesty panels which are disposed beneath the rear edges of the work surface, inset from the rear edges of the work surface to permit wiring to be hiddenly disposed behind the inset modesty panels, including adjacent furniture components on both sides of said corner section, each of which components has a work surface, and wherein each of said adjacent furniture components have a front edge parallel to aback edge, a side edge normal to said front and rear edges, and an oblique edge at a 45-degree angle to said front edge thereof, said component when in position abutting said corner section and said component having its oblique edge intersecting the front edge of said corner section at a 90-degree angle, and wherein the extension of the respective side edges of said corner desk section is dimensionally smaller than the extension of the respective side edge of any adjacent furniture component that may be used therewith, which prospective side edge would be the distant side edge of such furniture component from the side of said corner desk section, and would not be the side edge that would abut the front of said corner desk, and further wherein at least one of said adjacent furniture components has a rear wall disposed beneath the rear edge of its work surface, inset from the rear edge of the work surface to permit wiring to be hiddenly disposed behind the inset rear wall.

4. The advanced corner computer desk of claim 3 wherein each adjacent furniture component is selected from the group consisting of bookcases, cabinets, shelves, and drawers.

5. The advanced corner computer desk of claim 3 the rear wall of at least one of said adjacent furniture components has a wire grommet therein.

6. The advanced corner computer desk of claim 3, wherein the work surfaces of the corner desk section and of the adjacent furniture components are covered with at least one member selected from the group consisting of wood and high pressure laminate.

7. An advanced computer corner desk comprising:

a corner section comprising a pentagonal work surface having a top side and an underside with a front edge, two side edges in which each one is on the opposite ends of the front edge and disposed at a 45-degree angle to said front edge, and two rear edges which meet at a 90-degree angle, the extension of the side edges being less than the extension of the rear edges, a keyboard platform mounted beneath said front edge and which moves outwardly from said front edge for utilization and sized in one dimension up to about 27 inches to receive both a keyboard and an adjacent mouse, the underside of said corner desk section's work surface having a control switch electrically connected to a surge protector unit having a plurality of electrical outlets therein, said surge protector having a line cord and plug thereon; and said corner desk section's work surface having an aperture there through at the rear thereof, wherein said corner desk section has recessed modesty panels which are disposed beneath the rear edges of the work surface, inset from the rear edges of the work surface to permit wiring to be hiddenly disposed behind the inset modesty panels, and further including adjacent furniture components on at least one side of said corner section, wherein each of said adjacent furniture components have a work surface having a front edge parallel to a rear edge, a side edge normal to said front and rear edge, and an oblique edge at a 45-degree angle to said front edge thereof, said component when in position abutting said corner section, having its oblique edge intersecting the front edge of said corner section at a 90-degree angle, wherein the extension of each of the respective side edges of said corner desk section is dimensionally smaller than the extension of the respective side edge of any adjacent furniture component that is the distant side edge from the said corner desk and is not the side edge that abuts the front edge of said corner desk, further wherein at least one of the at least one adjacent furniture components has a rear wall disposed beneath the rear edge of the work surface, inset from the rear edge of the work surface to permit wiring to be hiddenly disposed behind the inset rear wall and the at least one adjacent furniture components comprise members selected from the group consisting of bookcases, shelf members, cabinets and drawers and wherein all of the work surfaces are selected from the group consisting of wood and high pressure laminate, and wire management means disposed on the underside of the corner desk section's work surface adapted to receive wiring from both a control switch and from a surge protection unit, wherein the wire management means is two J-shaped channels each mounted at a 90-degree angle to each other along the rear edges.

8. In the desk of claim 7, wherein the rear wall of the at least one adjacent furniture component is a grommet bearing apertured sear wall.

* * * * *